US006966092B2

(12) United States Patent
Sebor

(10) Patent No.: US 6,966,092 B2
(45) Date of Patent: Nov. 22, 2005

(54) SWIMMING POOL CLEANING APPARATUS

(76) Inventor: Pavel Sebor, 751 Cricklewood Ter., Heathrow, FL (US) 32746

( * ) Notice: Subject to any disclaimer, the term of this patent is extended or adjusted under 35 U.S.C. 154(b) by 0 days.

(21) Appl. No.: 10/621,070

(22) Filed: Jul. 16, 2003

(65) Prior Publication Data

US 2004/0010868 A1 Jan. 22, 2004

Related U.S. Application Data

(60) Provisional application No. 60/396,208, filed on Jul. 16, 2002.

(51) Int. Cl.[7] ..... E04H 4/16
(52) U.S. Cl. ..... 15/1.7; 137/494
(58) Field of Search ..... 15/1.7; 137/494

(56) References Cited

U.S. PATENT DOCUMENTS

| | | | | |
|---|---|---|---|---|
| 3,481,250 | A | 12/1969 | Toby | |
| 4,023,227 | A | 5/1977 | Chauvier | |
| 4,133,068 | A | 1/1979 | Hofmann | |
| 4,193,156 | A | 3/1980 | Chauvier | |
| 4,208,752 | A | 6/1980 | Hofmann | |
| 4,351,077 | A | 9/1982 | Hofmann | |
| 4,463,468 | A | 8/1984 | Chauvier | |
| 4,530,125 | A | 7/1985 | Hofmann | |
| 5,341,847 | A | 8/1994 | Rissik et al. | |
| 5,398,362 | A | 3/1995 | Chauvier | |
| 5,418,994 | A | 5/1995 | Rissik et al. | |
| 5,421,054 | A | 6/1995 | Dawson et al. | |
| 5,465,443 | A | 11/1995 | Rice et al. | |
| 5,706,540 | A | 1/1998 | Niewiarowski | |
| 5,794,293 | A | 8/1998 | Hoffinger | |
| 5,797,156 | A | 8/1998 | Sebor | |
| 5,970,557 | A | 10/1999 | Supra | |
| 6,112,354 | A | 9/2000 | Stoltz et al. | |
| 6,122,794 | A | 9/2000 | Atkins | |
| D436,700 | S | 1/2001 | Forbes et al. | |
| 6,298,513 | B1 | 10/2001 | Rief et al. | |
| 6,463,614 | B1 * | 10/2002 | Supra | 15/1.7 |
| 2002/0002750 | A1 | 1/2002 | Phillipson et al. | |
| 2002/0116772 | A1 | 8/2002 | Phillipson et al. | |
| 2002/0166185 | A1 | 11/2002 | Balint | |

* cited by examiner

*Primary Examiner*—Randall Chin
(74) *Attorney, Agent, or Firm*—Allen, Dyer, Doppelt, Milbrath & Gilchrist, P.A.

(57) ABSTRACT

A submersible cleaner includes a valve within a flow passage for interrupting fluid flow and thus drive the cleaned over submerged surfaces to be cleaned. A retractable element moveable between the valve and a wall within the passage reduces a gap formed between them such that flow through the passage is directed along one side of the valve resulting in improved driving power and reduced clogging by debris passing through the passage. The retractable element may be attached to either the valve or the wall, and may make slidable engagement with between them. A flexible plate engaging the surface includes a plurality of tongues radially extending about the periphery with each tongue having a lower surface portion contacting the surface to be cleaned and an outmost portion contoured away from the surface.

52 Claims, 15 Drawing Sheets

SWIMMING POOL CLEANING APPARATUS

CROSS-REFERENCE TO RELATED APPLICATIONS

This application claims priority to Provisional Application No. 60/396,208 for Swimming Pool Cleaning Apparatus and Method, filed Jul. 16, 2002, the disclosure of which is incorporated herein by reference in its entirety.

FIELD OF THE INVENTION

The present invention generally relates to self propelled swimming pool cleaners for cleaning submerged surfaces, and more particularly to a swimming pool cleaning apparatus incorporating a flow control valve for establishing intermittent flow of a fluid through the cleaner for causing the cleaner to travel across the surface to be cleaned.

BACKGROUND OF THE INVENTION

Submersible pool cleaners employing oscillating valves within a housing and flexible discs engaging the surface to be cleaned are generally well known, as illustrated by way of example with reference to U.S. Pat. Nos. 4,023,227 to Chauvier and 4,351,077 to Hofmann. What is also generally known are the problems associated with debris clogging fluid flow passages, wearing cleaner components rendering the cleaner ineffective or unusable, and the difficulty for a consumer attempting to replace such worn components. Embodiments of the present invention herein described provide an efficiently run submersible cleaner which includes components that are easily replaceable by the consumer.

SUMMARY OF THE INVENTION

A submersible cleaner in keeping with the teachings of the present invention may include a housing moveable along a submerged surface to be cleaned through fluid flow past a valve operable for moving the cleaner. The housing may include a flow passage for a flow of fluid and debris from an inlet to an outlet with the fluid and debris constrained to flow through an opening defined within the passage. A wall may extend into the flow passage for defining the opening. A valve may be operable within the flow passage for interrupting fluid flow. A retractable element may be moveable between the valve and the wall for reducing a gap formed between them. The retractable element may be attached to either the valve or the wall, and may make slidable engagement.

A flexible plate may be carried proximate the inlet for engaging the surface to be cleaned. The flexible plate may be described to include an upper surface, an opposing lower surface for contacting the surface to be cleaned, and a periphery defined by a plurality of tongues radially extending about the periphery. Each of the plurality of tongues may include a lower surface portion for contacting the surface to be cleaned and a contouring portion in a spaced relation with the surface to be cleaned during operation of the apparatus, thus upwardly lifting an outer most periphery of the plate from the surface to be cleaned. A plurality of reinforcing elements may be integrally formed with the flexible plate for upwardly contouring the periphery from the surface to be cleaned. The reinforcing elements may include a rib that may be integrally formed with the upper surface of the flexible plate with the rib extending radially outward while confined within the periphery of the flexible plate. Alternatively, the reinforcing element may comprise a flange extending along the peripheral edge of the tongue, or yet other reinforcing styled elements.

BRIEF DESCRIPTION OF THE DRAWINGS

Embodiments of the invention are described by way of example with reference to the accompanying drawings in which.

DETAILED DESCRIPTION OF THE PREFERRED EMBODIMENTS

Embodiments of the present invention will now be described more fully with reference to the accompanying drawings. It will be understood by those skilled in the art that this invention may be embodied in many different forms and should not be construed as limited to the embodiments set forth herein. Rather, these embodiments are provided so that this disclosure will be thorough and complete, and will fully convey the scope of the invention to those skilled in the art. Like numerals refer to like elements.

Figure 1:
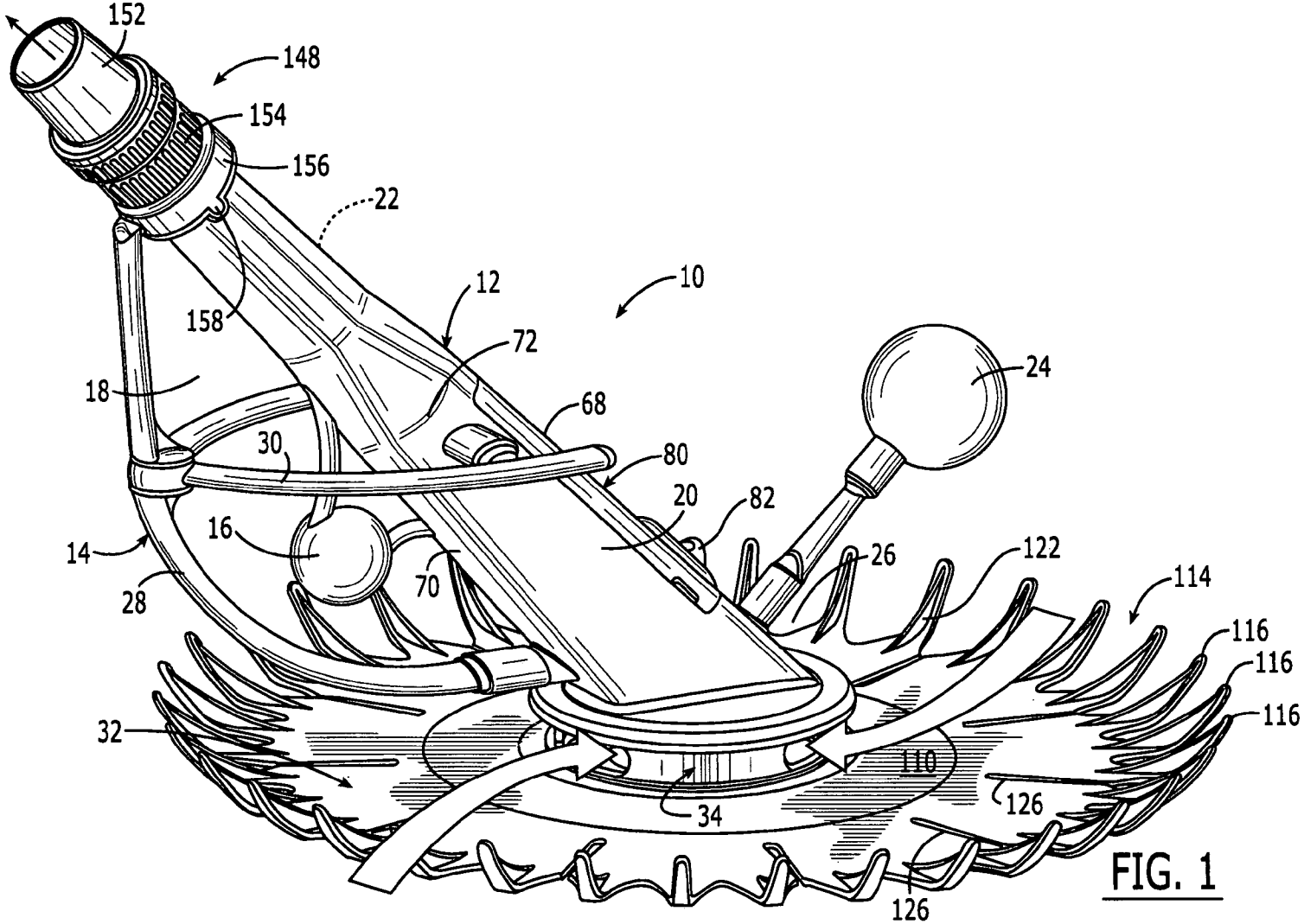
FIG. 1 is a left side perspective view of one embodiment of a swimming pool cleaner according to the present invention.
Figure 2:
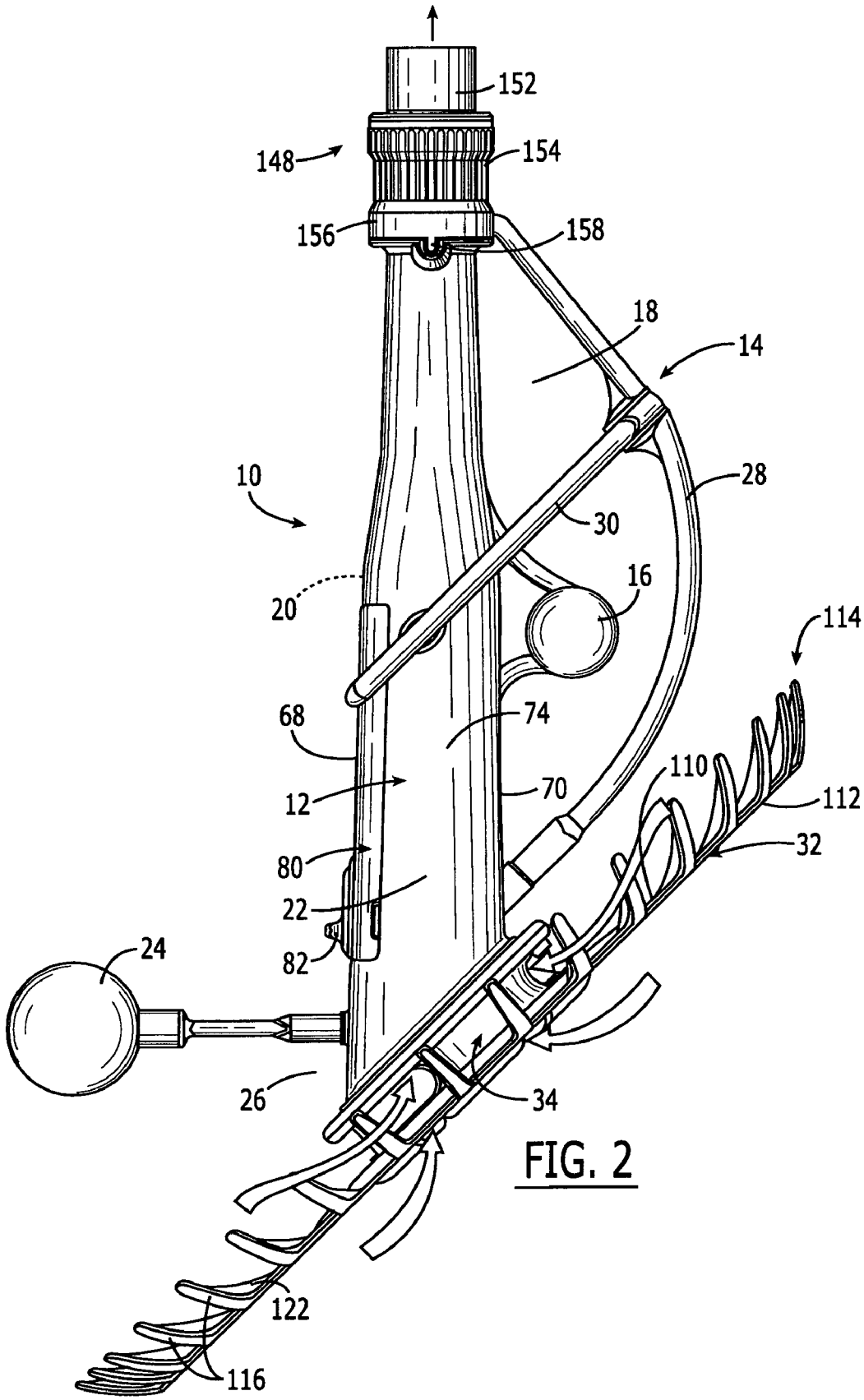
FIG. 2 is a right side elevation view of the cleaner of FIG. 1.

With reference initially to FIGS. 1 and 2, an embodiment of the present invention is herein described, by way of example, for a submersible swimming pool cleaner 10 having a housing 12 inclined toward a direction of travel, which housing carries a bumper 14 and weight 16 about a forward portion 18 with the bumper extending to left and right side portions 20, 22. A float 24 is carried at an aft portion 26 for acting in conjunction with the weight 16 in allowing the cleaner 10 to fall to an upright position when dropping from a sidewall of a swimming pool. Vertical and horizontal bumper members 28, 30 are effective in having the cleaner avoid obstructions within the swimming pool, such as steps and sharp corners. The housing 12 further carries a flexible plate 32 via attachment with a footpad 34.

The housing 12 includes a single flow passage 36 extending from an inlet 38 to an outlet 40 for a flow of fluid and debris through the passage, as described with reference to FIG. 3. A partition wall 42 extends into the single flow passage 36 such that the flow of fluid and debris (illustrated with arrows 44) are constrained to pass through an opening 46 formed thereby and pass to the outlet 40, which outlet is adapted for connection to a suction source 48. The flexible plate 32 is carried about the inlet 38 for engaging a submerged surface 50 to be cleaned. A valve 52 is pivotally carried within the flow passage 36 for interrupting fluid flow 44 through the passage during an oscillation of the valve between a seated position 54 for interrupting the flow to an unseated position 56 permitting the flow, as illustrated with reference to FIGS. 4 and 5. The valve 52 interrupts flow through the passage 36 resulting in a motion of the inclined housing 12 causing it to travel along the surface of the pool to be cleaned, the valve thus acting as the "motor" for the pool cleaner. With continued reference to FIG. 3, a suction of the fluid through the flow passage 36 causes an oscillating of the valve between the seated and the unseated positions and a resulting movement of the cleaner 10 across the submerged surface 50.

Figure 3:
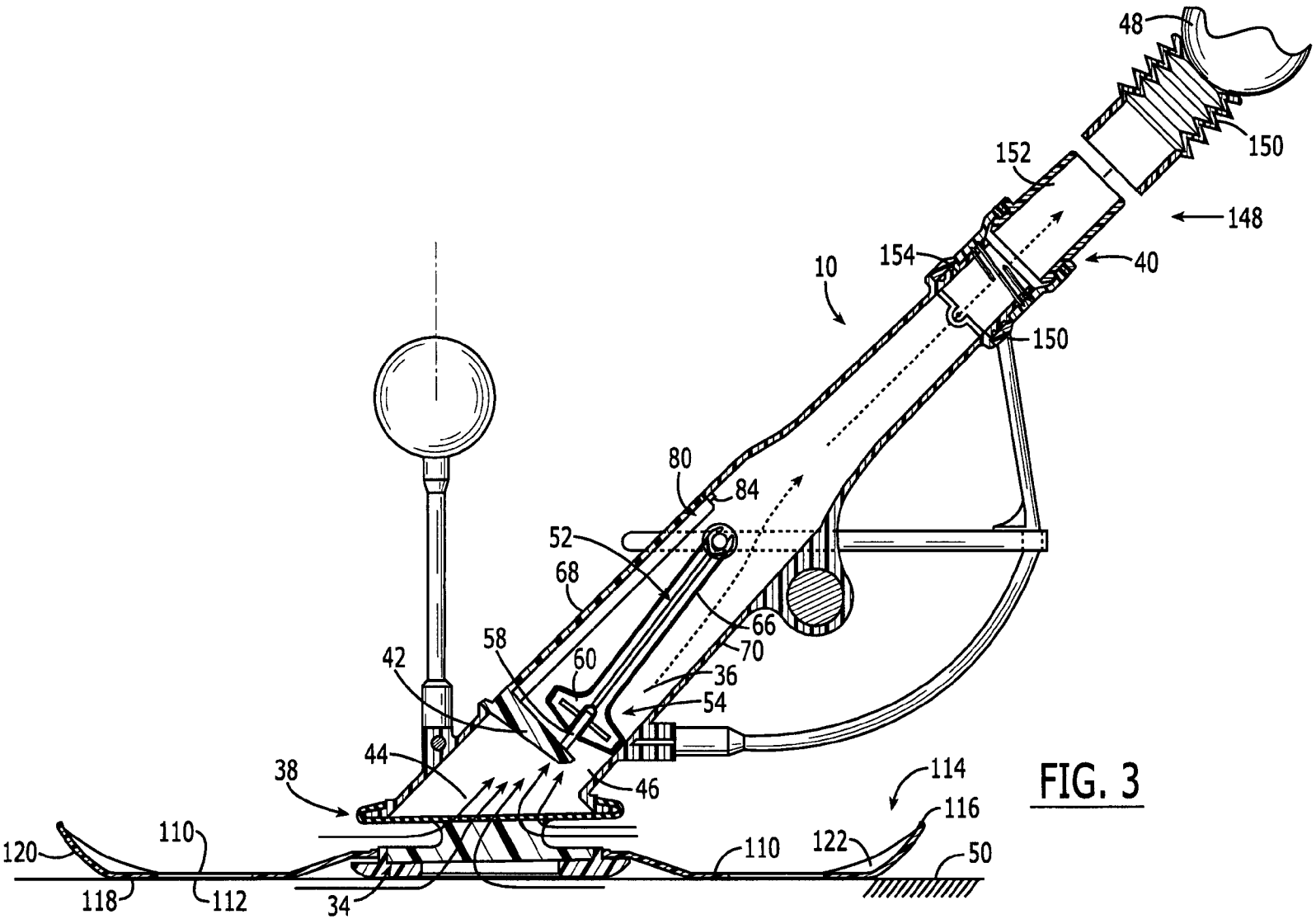
FIG. 3 is a partial cross section view of a pool cleaner illustrating fluid flow therethrough.
Figure 4:
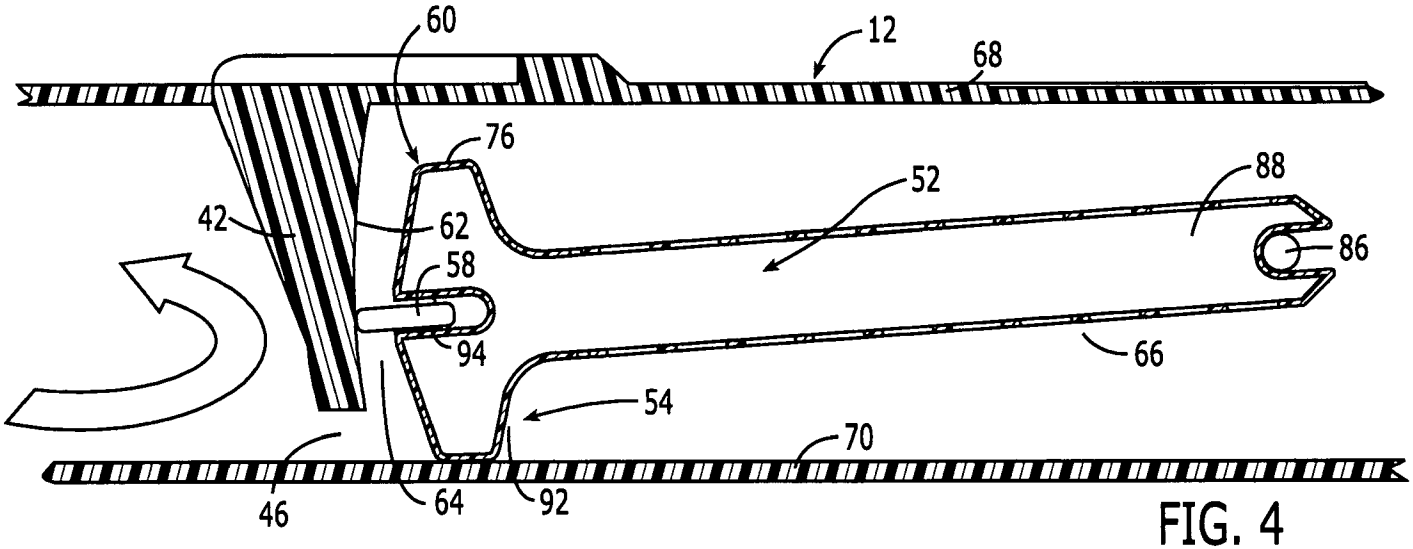
FIGS. 4 and 5 are partial cross section view of a housing portion of the embodiment of FIG. 3 illustrating an enlarged view of the oscillator valve in a seated position and an unseated position, respectively.
Figure 5:
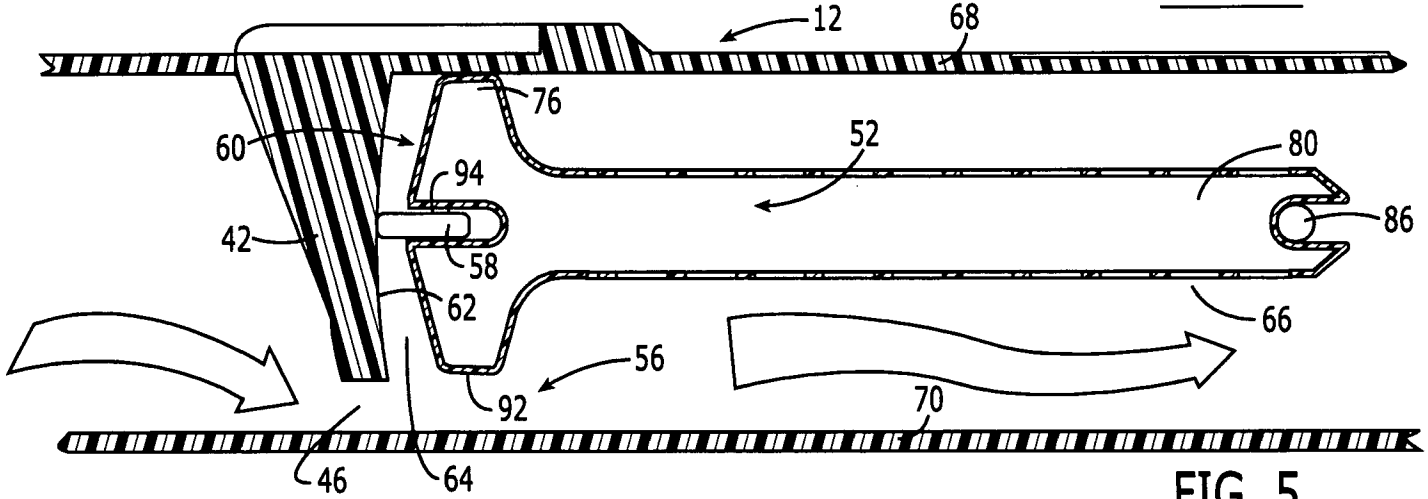
Figure 6:
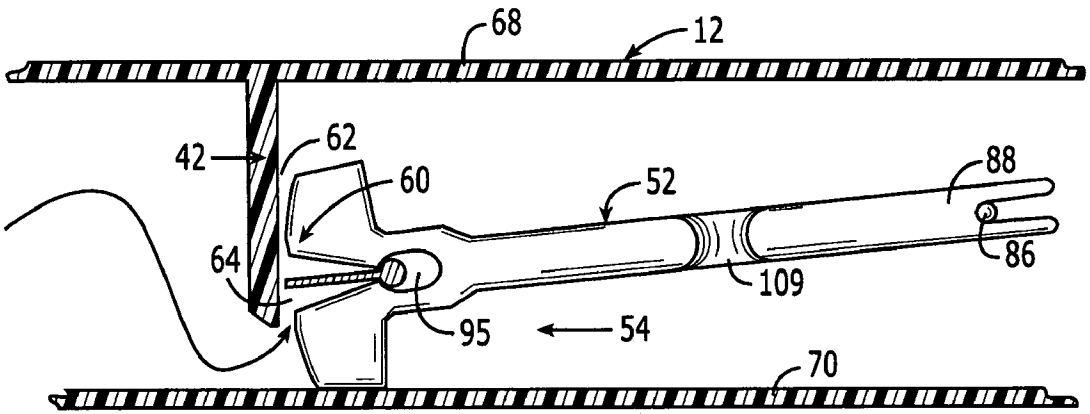
FIG. 6 is an alternate embodiment of the valve in keeping with the teachings of the present invention.

With continued reference to FIGS. 3–5, a retractable element 58 is moveable between a valve distal end 60 and a surface 62 of the partition wall 42 for reducing a gap 64 formed between them, thus substantially limiting the flow of the fluid and debris to only one side 66 of the valve 52. The retractable element 58 may be dimensioned such that the fluid flow through the passage 36 causes the retractable element to have slidably engagement between the valve distal end 60 and the surface 62 of the partition wall 42 during the oscillation of the valve, as illustrated with reference again to FIGS. 4 and 5, or alternatively may fully close or simply reduce the size of the gap 64, as illustrated with reference to FIG. 6.

With reference again to FIGS. 1–5, the single flow passage 36 may be defined by opposing top and bottom walls 68, 70 in combination with opposing left and right sidewalls 72, 74, wherein the distal end 60 of the valve 52 contacts the bottom wall 70 in the seated position 54 and oscillates between the seated position and a stop 76 formed with the distal end 60 for contacting the top wall 68.

Figure 7:
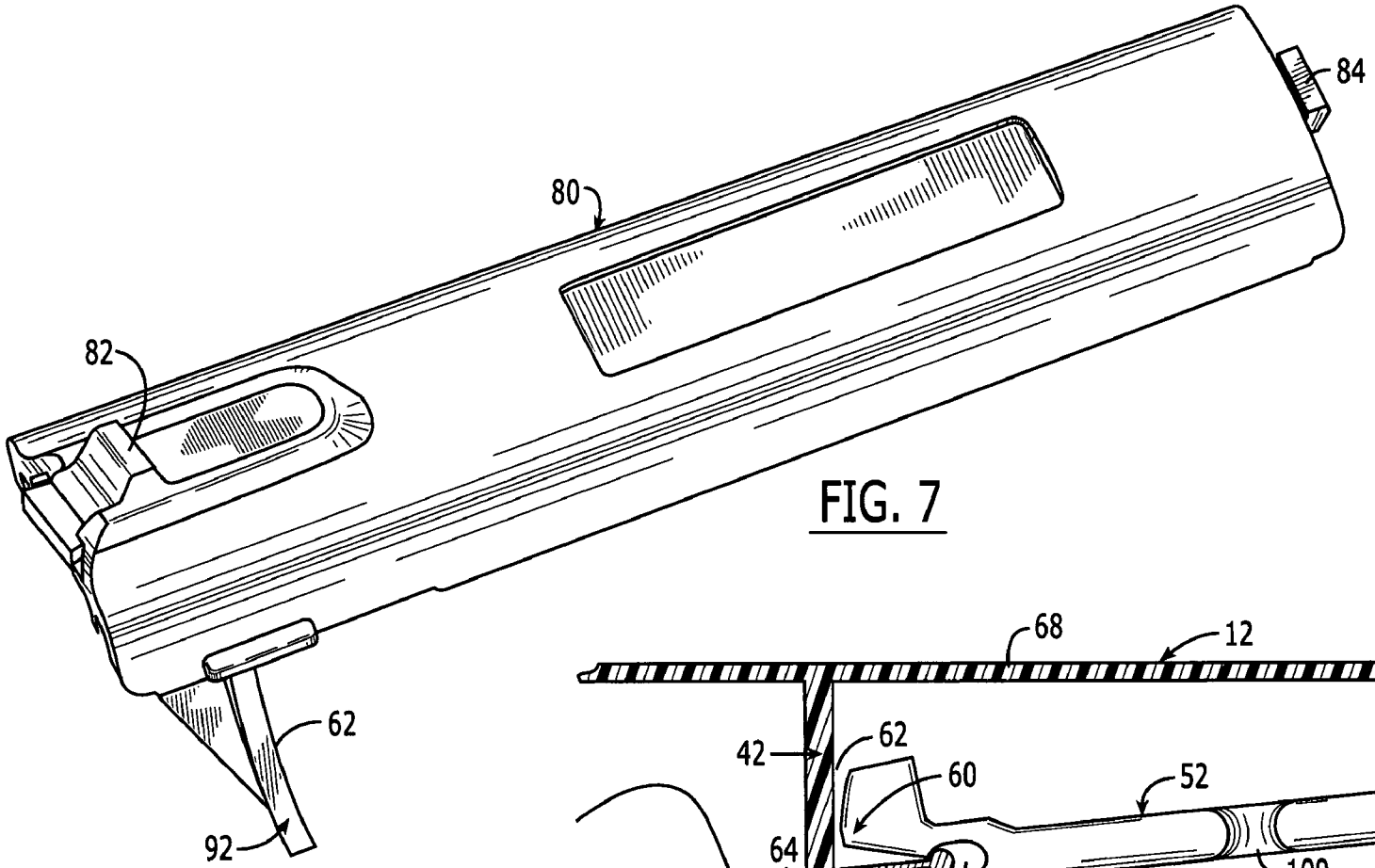
FIG. 7 is a perspective view of a cover.
Figure 8:
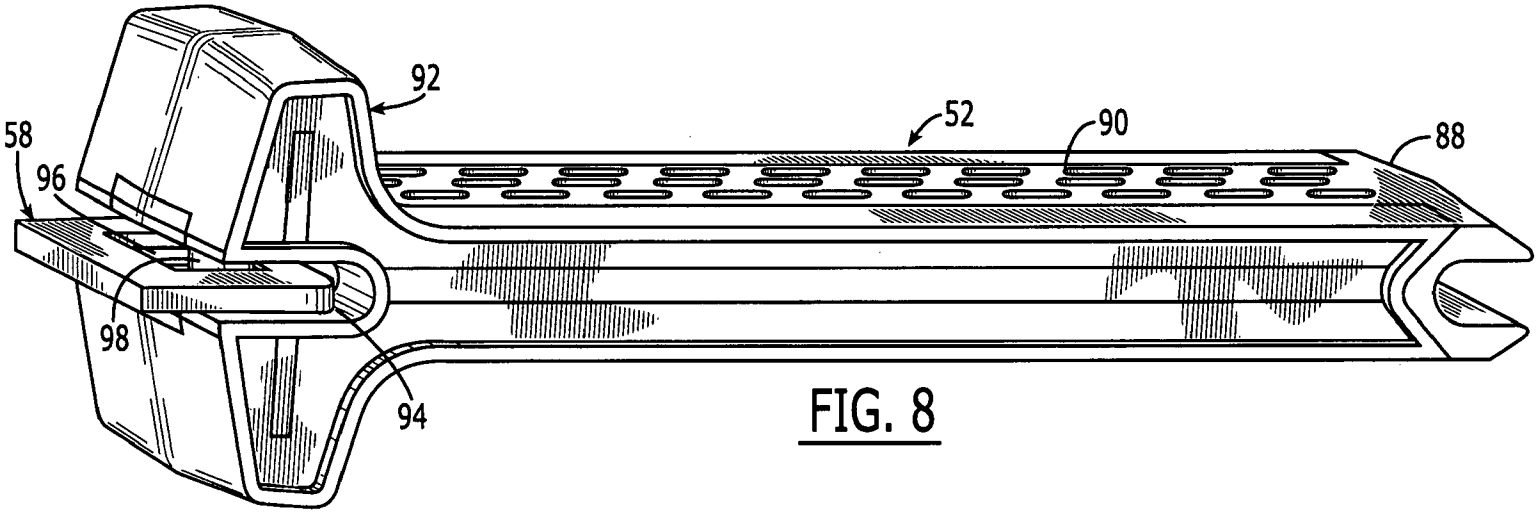
FIGS. 8 and 9 are perspective and side views of an embodiment of a valve.
Figure 9:
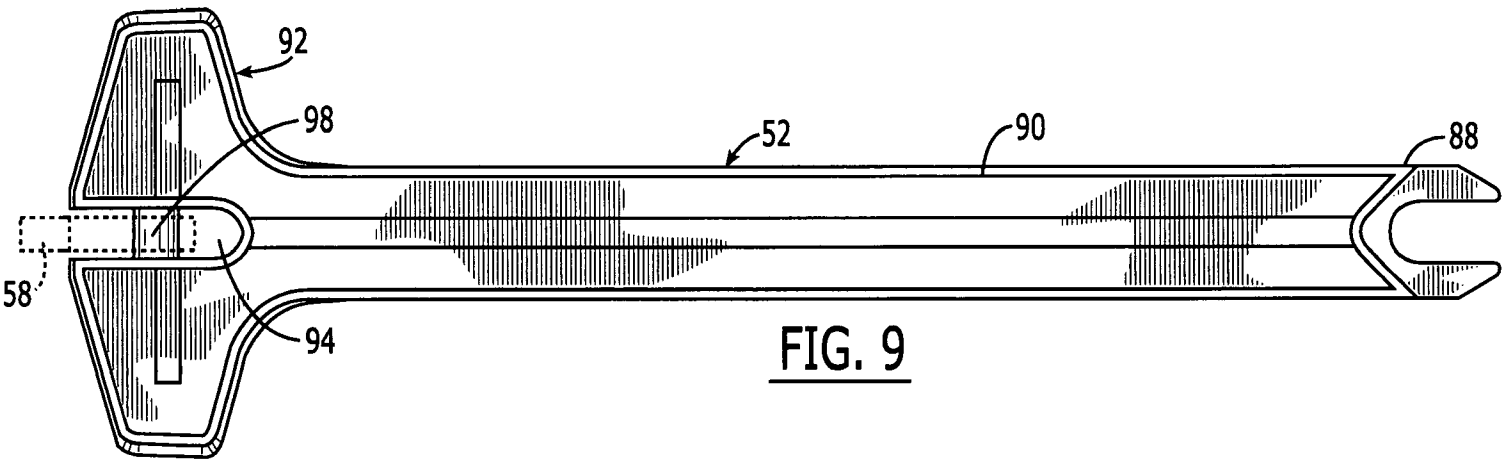
Figure 10:
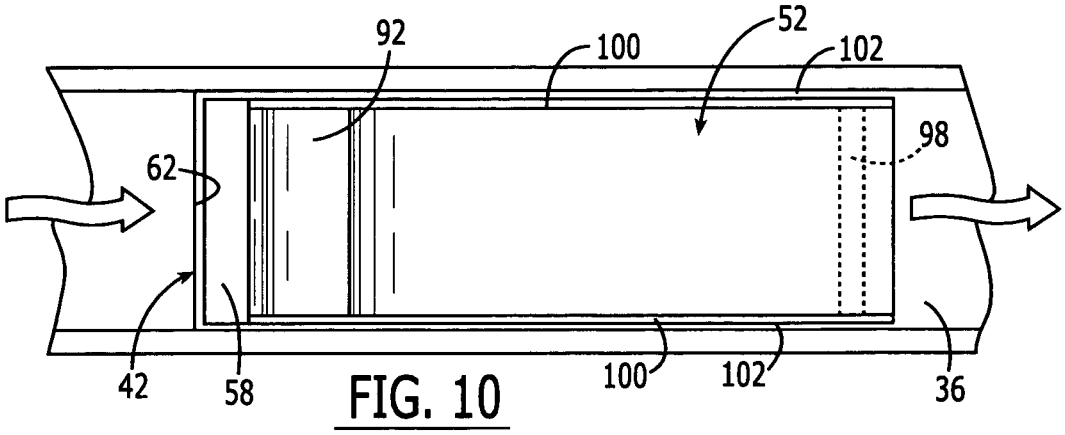
FIG. 10 is a partial top view looking down on the valve carried within the housing.

As illustrated with reference again to FIGS. 1–5, an access opening 78 within the top wall 68 provides entry into the housing 12 and the flow passage 36. A detachable cover 80 encloses the opening 78. Access to the flow passage provides a convenience when clearing out debris lodged therein or replacing the valve, by way of example. In one embodiment of the cleaner, as herein described by way of example, the partition wall 42 is integrally formed with the cover 80, as further illustrated with reference to FIG. 7. The cover 80 includes a lock 82 and tab 84 located at ends of the cover for securing the cover to the housing 12 for covering the opening 78. A pivot pin 86 is carried by the housing 12 for pivotal connection with a proximal end 88 of the valve 52. As illustrated with reference again top FIGS. 4 and 5, the valve 52 may be constructed to include an elongate arm 90 having the proximal end 88 for connection to the pivot pin 86. A head portion 92 is located at the valve distal end 60. The distal end 60 is carried within the passage 36 upstream the proximal end 88. In the embodiment illustrated with reference to FIGS. 4 and 5, by way of example, the head portion 92 includes a slot 94 for slidably receiving the retractable element 58. One embodiment of the retractable element 58 includes a slit 96 that is operable with a pin 98 carried within the slot 94, as illustrated with reference to FIGS. 8 and 9. Flexible side edges 100 extend along the longitudinal sides of the valve 52 for minimizing side gaps 102 on the sides of the valve and for providing a close fit, as further illustrated with reference to FIG. 10, thus enhancing control of the fluid flow along the one side 66 of the valve 52, as earlier described with reference to FIGS. 3–5.

Figure 11:
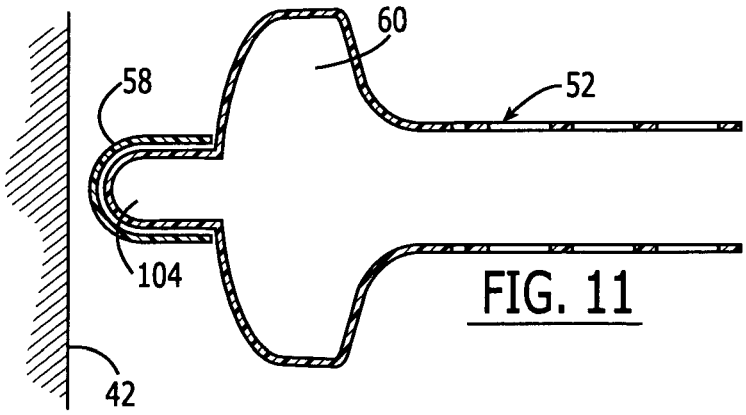
FIGS. 11 and 11A illustrate alternate embodiments having a retractable element carried by the valve and alternatively by a partition wall, respectively.
Figure 11A:
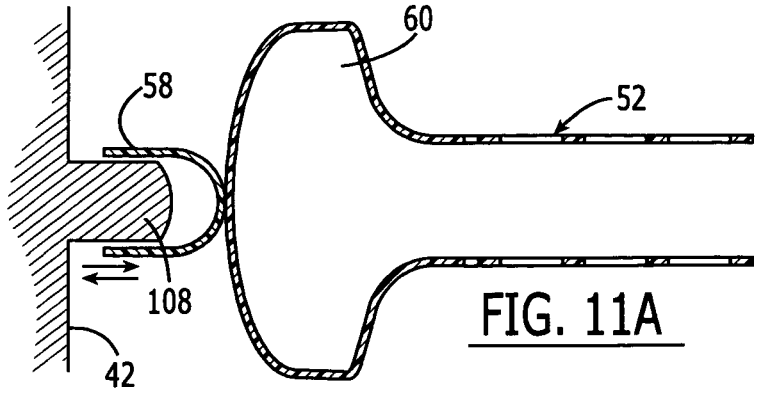
Figure 12:
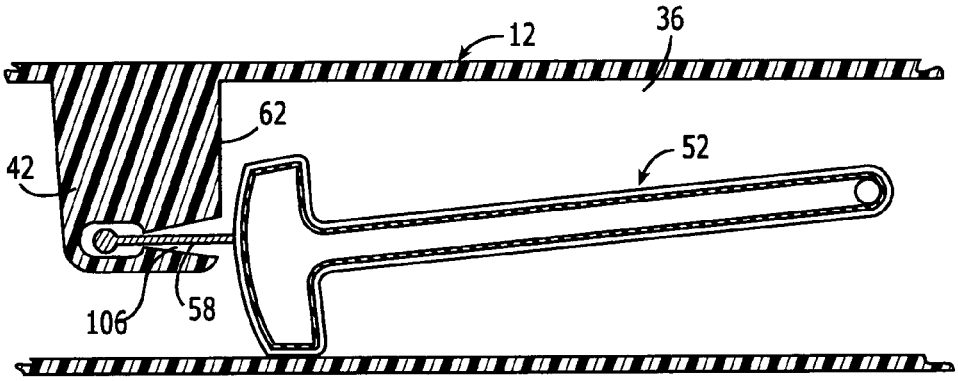
FIG. 12 is a partial cross section view illustrating an alternate embodiment of the invention including a retractable element carried by a partition wall.
Figure 13:
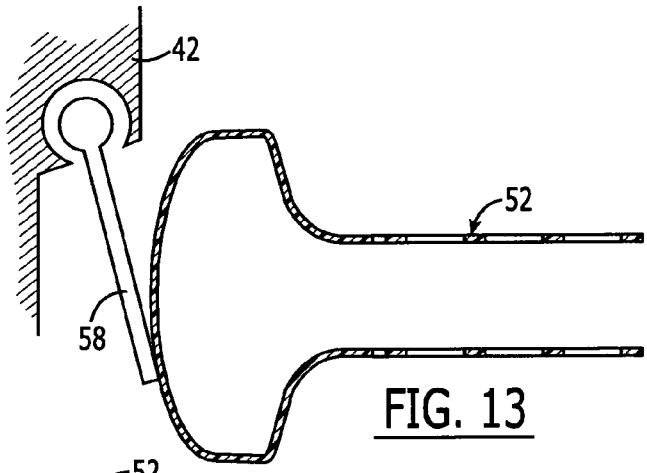
FIGS. 13–20 illustrate alternate embodiments of the valve operable with the retractable element.
Figure 14:
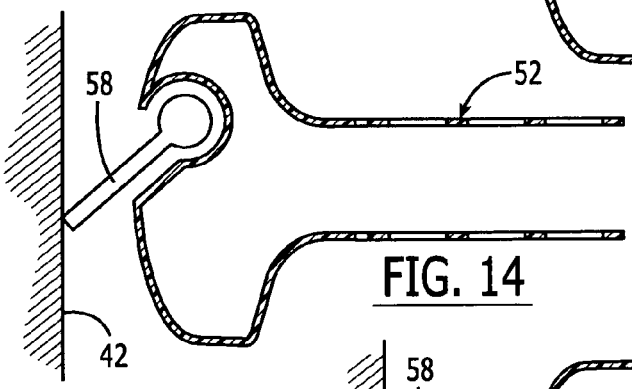
Figure 15:
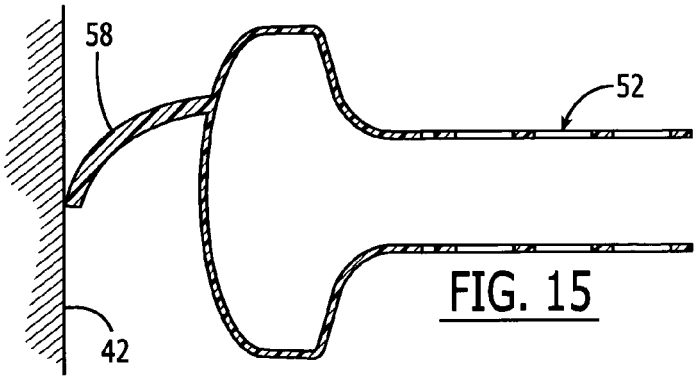
Figure 16:
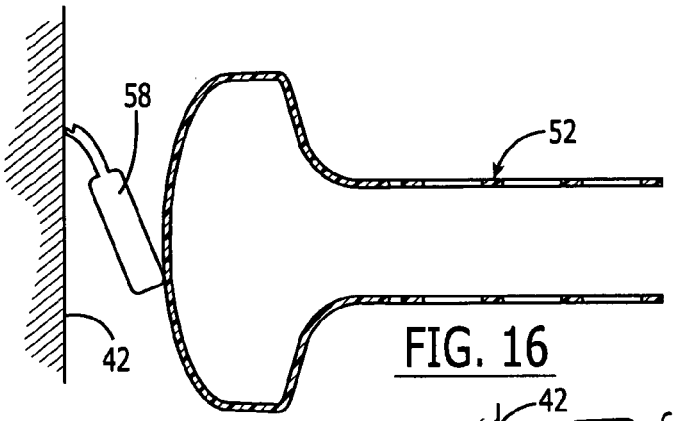
Figure 17:
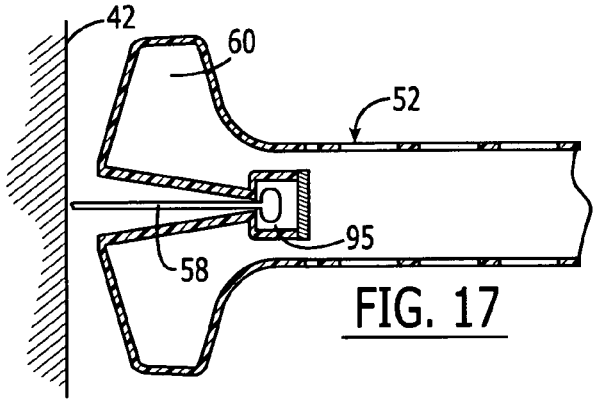
Figure 18:
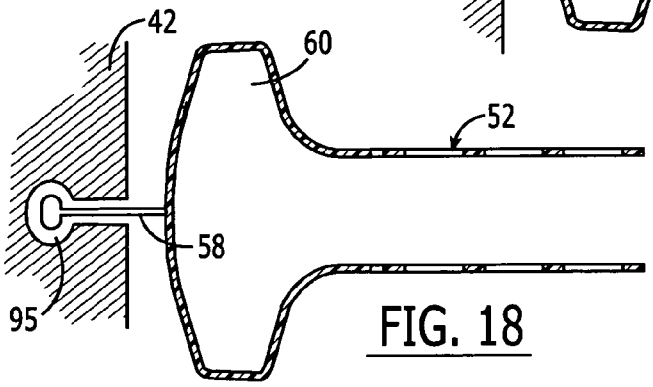

Alternate embodiments keeping within the teachings of the present invention, may include by way of example, the head portion 92 having a protrusion 104 extending radially outward from the valve distal end 60 for slidably receiving the retractable element 58, as illustrated with to reference to FIG. 11. Further, the partition wall 42 may include a slot 106 extending for slidably receiving the retractable element 58, as illustrated with reference to FIG. 12. Yet further, the partition wall 42 may include a protrusion 108 extending outward toward the valve 52 for slidably receiving the retractable element 58, as illustrated by way of further example with reference to FIG. 11A. As herein illustrated, the retractable element 58 may have various shapes and may be attached to the valve 52 or to the partition wall 42 without deviating from the teachings of the present invention, and may or may not fully close the gap 64, as illustrated with reference to FIGS. 13–20.

Figure 19:
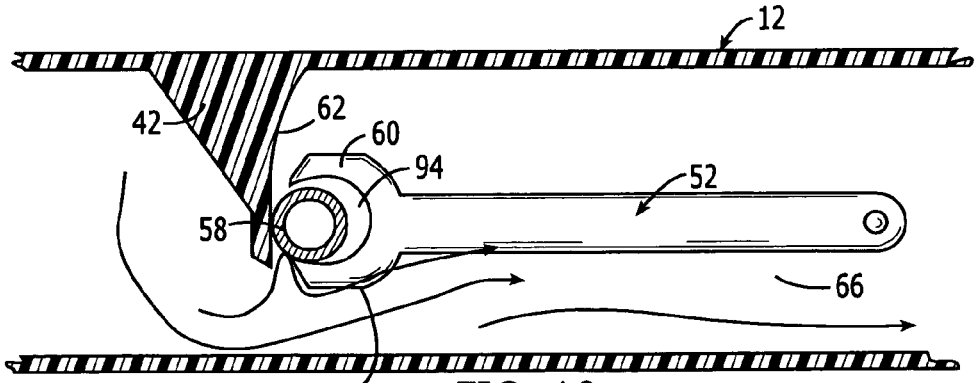
Figure 20:
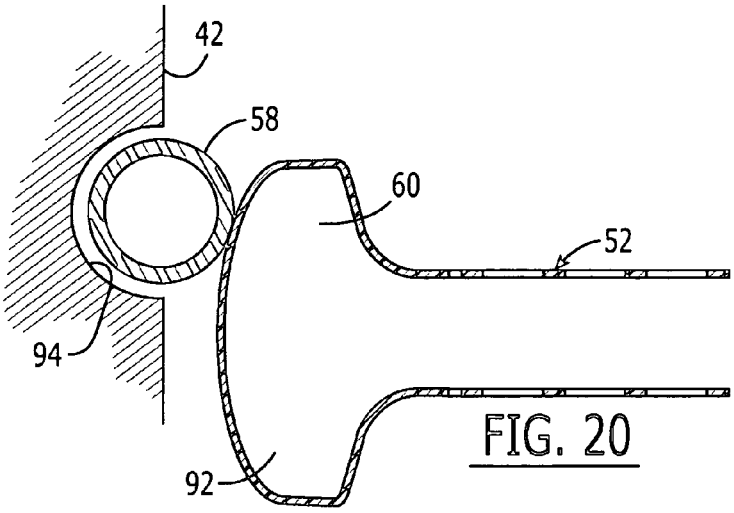

With reference to FIGS. 19 and 20, by way of example, the generally circular cross sectional shape of the retractable element 58 and carried within a generally arcuate shape for the slot 94 supports a rolling motion for the retractable element during movement of the head portion 92, thus reducing wear of the surface and element while remaining effective in directing fluid flow to the one side 66 of the valve 52. The retractable element 58 is movably carried within the slot 94 making continuous contact with the 62 of the partition wall 42 or in close proximity as herein described. With reference again to FIGS. 6, 12, and 17, an embodiment of the valve 52 includes the head portion 92 having an angled slot 94 tapering from outside toward a slotted hole 95, or alternatively having the tapered slot within the partition wall as illustrated with reference to FIG. 18. The head contact element includes an elongate portion having one end extending out of the slot 94 and an opposing end having a bulbous portion for a sliding movement within the hole 95. Such an embodiment allows the retractable element 58 to be secured within the slot 94 during installation and easily held therein during assembly of the valve.

Further, a flexible arm portion 109 may be provided as a shock buffer that results in reducing noise generated by the oscillating valve 52, as illustrated with reference again to FIG. 6.

Figure 21:
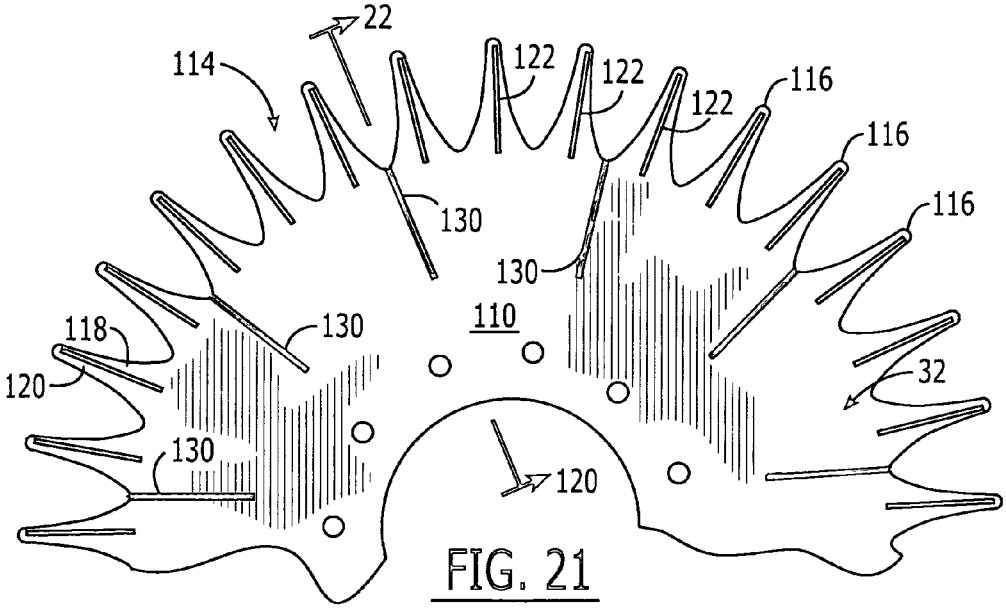
FIG. 21 is a partial top view of one embodiment of a flexible plate.
Figure 22:
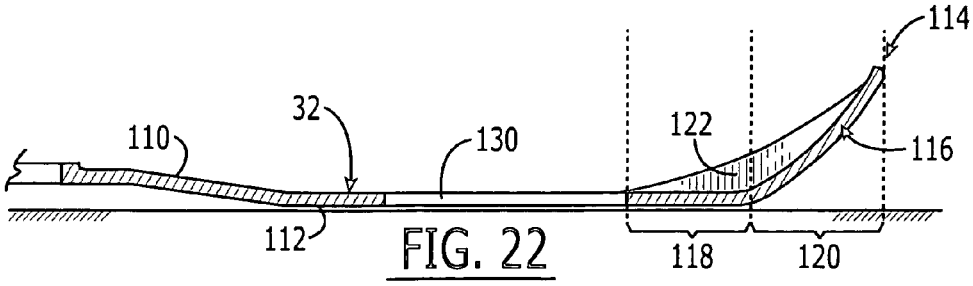
FIG. 22 is a partial cross section elevation view taken through lines 22—22 of FIG. 21.
Figure 23:
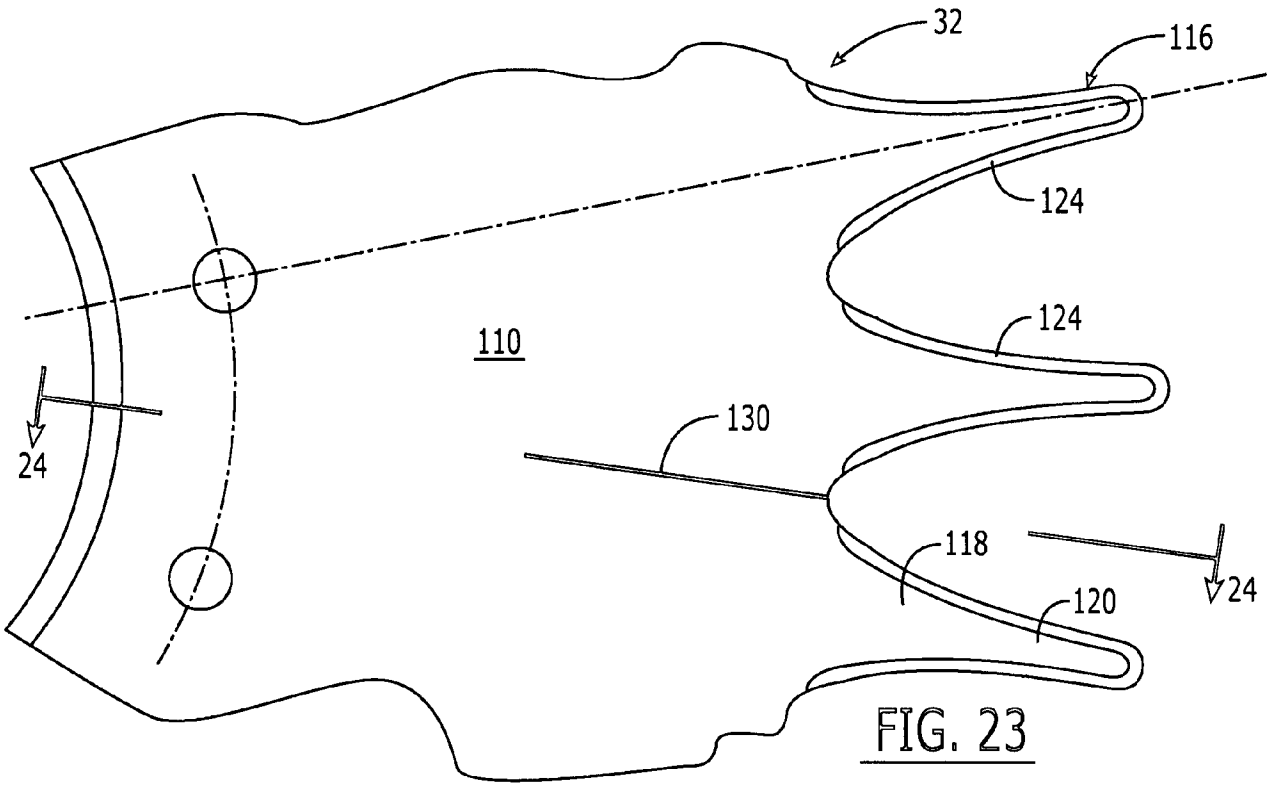
FIG. 23 is a partial top view of one embodiment of a flexible plate.
Figure 24:
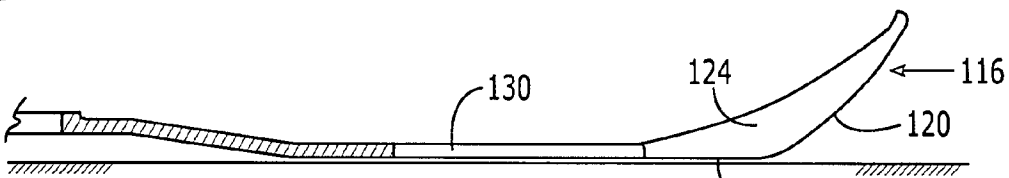
FIG. 24 is a partial cross section elevation view taken through lines 24—24 of FIG. 23.

With reference again to FIGS. 1–3, the flexible plate 32 may be described as having an upper surface 110 and an opposing lower surface 112 for contacting the surface to be cleaned 50. A periphery 114 of the plate 32 includes a plurality of tongues 116 radially extending thereabout. Each tongue 116 includes a lower surface portion 118 for contacting the surface to be cleaned 50 and a contoured portion 120 in a spaced relation with the surface to be cleaned during operation of the cleaner 10, as illustrated with reference again to FIG. 3, and to FIGS. 21 and 22, the outer most peripheral portion of the plate being upwardly lifted from the surface to be cleaned. In one embodiment, as herein illustrated, a rib 122 is integrally formed with the upper surface 110 of the flexible plate 32 at the tongue 116. The rib 122 reinforces the tongue 116 for securing the contoured portion 120 in the convex shape. Alternate reinforcing element shapes may be formed with the flexible plate 32 for upwardly contouring the periphery 114 upwardly from the surface to be cleaned 50, including a flange 124 extending along a peripheral edge of the tongue, as illustrated by way of example with reference to FIGS. 23 and 24.

Figure 25:
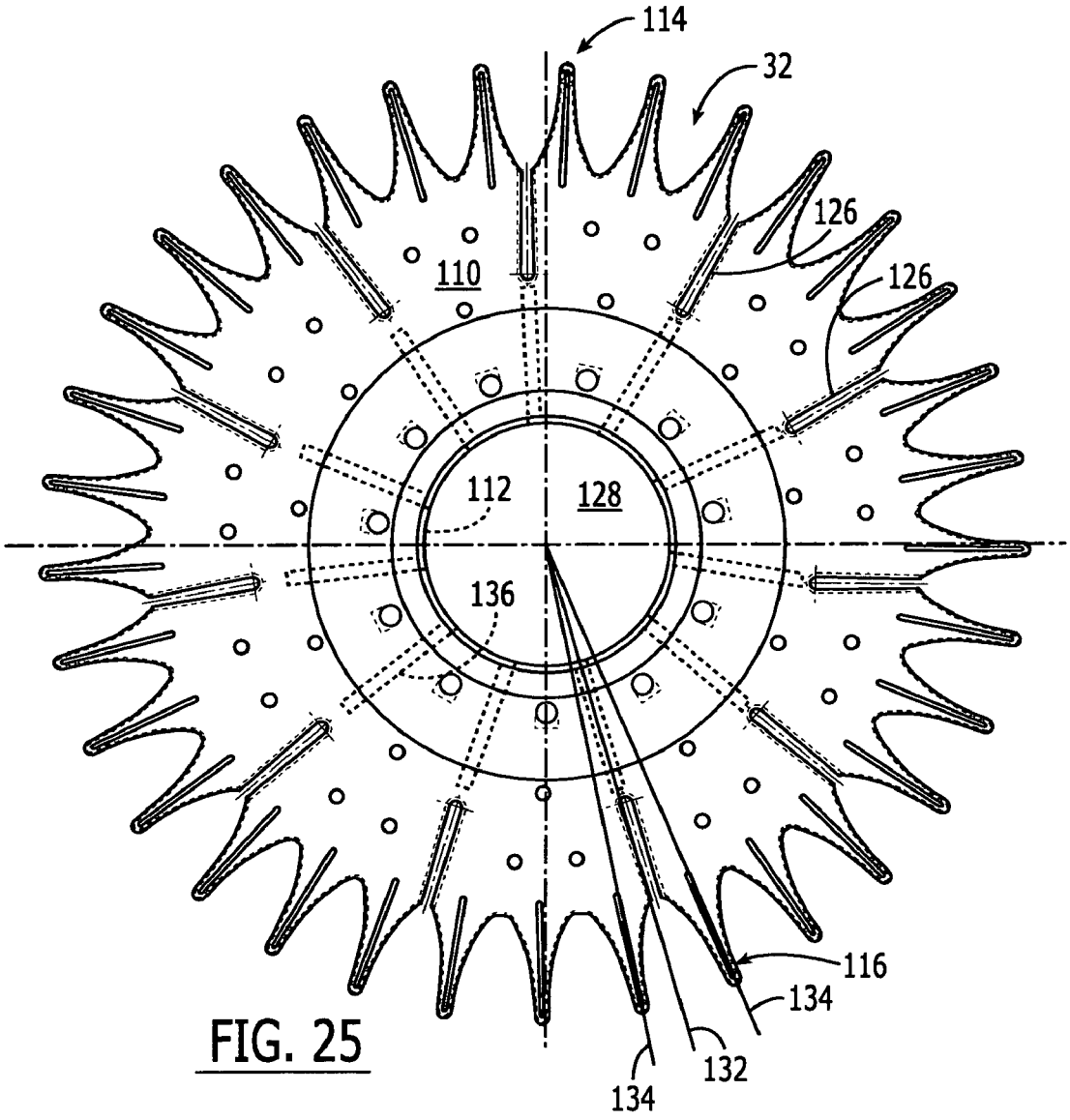
FIG. 25 is a top plan view of one embodiment of a flexible plate.

As illustrates with reference again to FIG. 2 and to FIG. 25, embodiments of the plate 32 may include slots 126 radially extending from a center 128 of the plate. The slot 126 herein described is tapered so as to provide a diminishing gap as the taper extends radially outward from the center 128. Alternatively, the plate 32 may include a slit 130, as illustrated with reference again to FIGS. 22 and 24. Yet further, a combination of tapered slot 126 and slit 130 may be formed within the plate 32, as illustrated with reference to FIG. 26, such slots and slits extending radially outward from the center 128 of the plate 32 provide added flexibility to the flexible plate 32 and improved maneuverability over contours within the surface to be cleaned 50. A plurality of slots or slit may be symmetrically located as herein illustrated or located as desired for surface conditions.

By way of further example, and as illustrated with reference again to FIG. 25, the plurality of slots may extend along a first imaginary line 132 centrally positioned between second imaginary lines 134 passing centrally through each of the plurality of tongues 116. Further, the plate 32 may include grooves 136 within the lower surface 112 and extending radially outward for the center 128. As illustrated, the grooves 136 may extend only partially between the center 128 and the periphery 114 of the plate 32.

Figure 29:
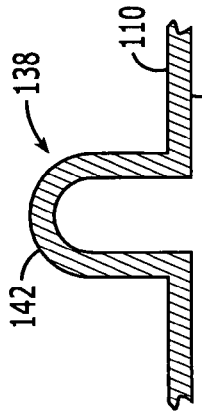
FIG. 29 is a partial cross section view taken through lines 29—29 of FIG. 27.
Figure 27:
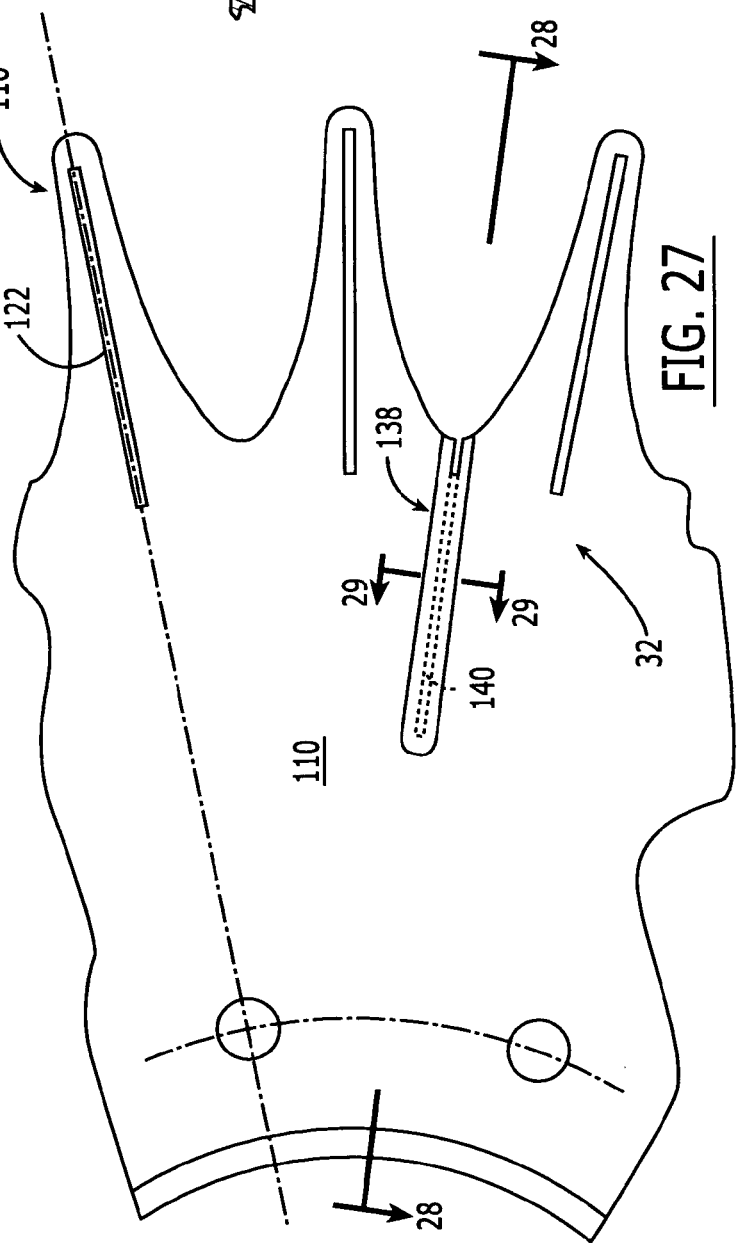
FIG. 27 is a partial top view of one embodiment of a flexible plate.
Figure 28:
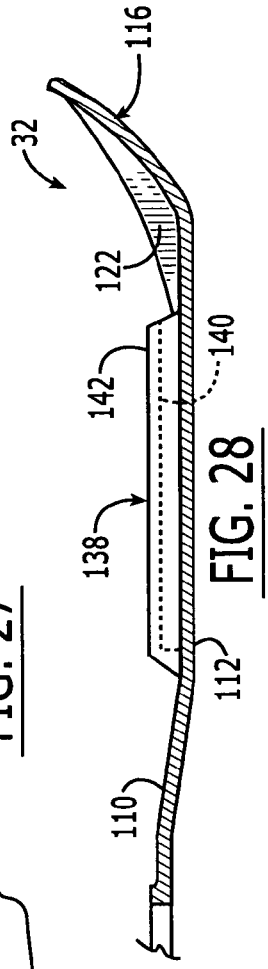
FIG. 28 is a partial cross section elevation view taken through lines 28—28 of FIG. 27.

Pleats 138 provide yet another alternative for adding flexibility to the plate 32, as illustrated with reference FIGS. 27–29. Each of a plurality of pleats 138 extending radially from the center 128 forms a groove 140 within the lower surface 112 and a protrusion 142 in the upper surface 110.

Figure 26:
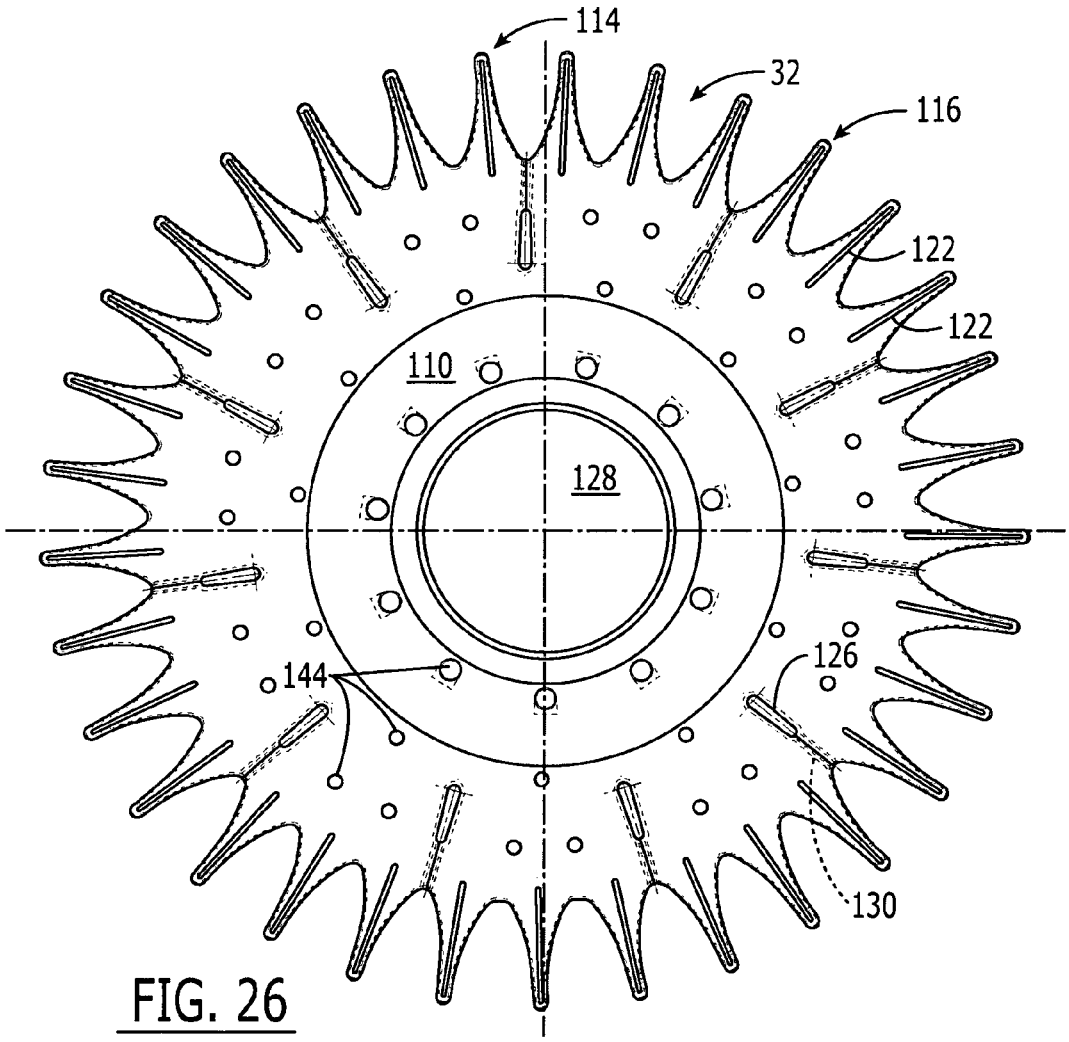
FIG. 26 is a top plan view of an alternate embodiment of a flexible plate.

With reference to FIG. 26, by way of example, the plate 32 may include a plurality of holes 144 extending from the upper surface 110 to the lower surface 112 for modifying a suction provided by the flexible plate during operation of the cleaner 10 with the suction source.

Figure 30:
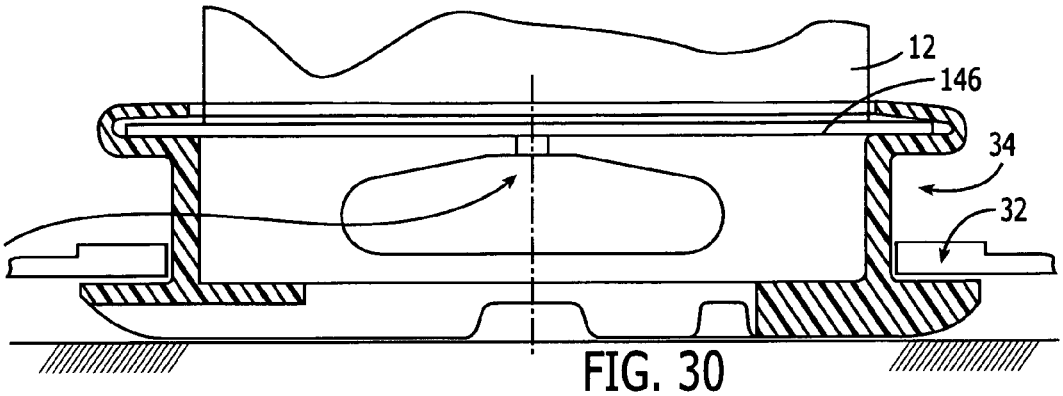
FIG. 30 is an elevation and partial cross section view of a footpad of FIG. 1.
Figure 31:
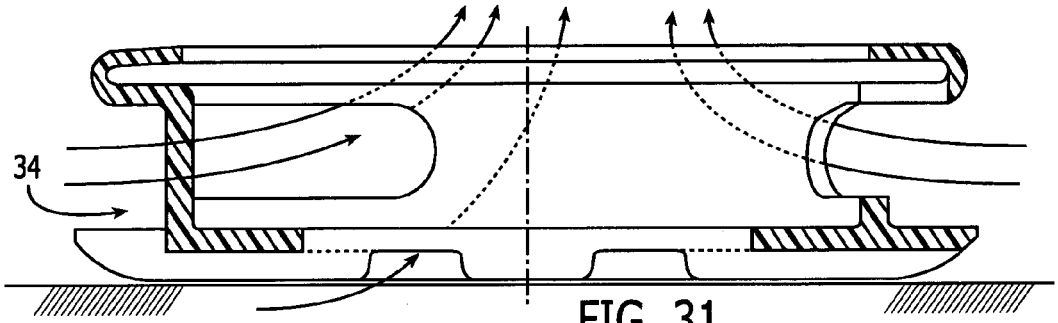
FIG. 31 is a side elevation and partial cross section view of the footpad of FIG. 30 illustrating front and rear lateral inlet ports.
Figure 32:
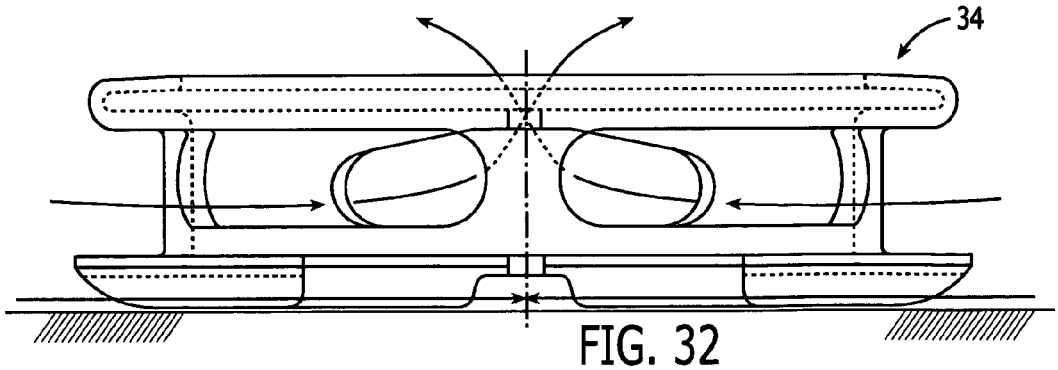
FIG. 32 is an elevation view of the footpad of FIG. 30 illustrating dual lateral inlet ports.

As earlier described with reference to FIGS. 1–3, the cleaner 10 herein described by way of example, includes a foot pad 34 which carries the plate 32. The foot pad 34 is attached to a flange 146 at the inlet 38 of the housing 12 as further illustrated with reference to FIG. 30. The footpad 34 is attached to the housing 12 and the flexible plate 32, and easily replaced by the consumer. As illustrated with reference to FIGS. 31 and 32 using arrows, fluid flow passes through openings within the footpad above the plate and below for providing an effective cleaning of debris from the surface to be cleaned. As illustrated with reference again to FIGS. 1–3, a hose connector 148 is carried at the outlet 40 of the housing 12. Under the influence of the vacuum source 48, typically a pump, a flexible hose 150 connected to the connector 148 causes fluid and debris to flow through the housing 12.

As illustrated with reference again to FIGS. 1–3, one embodiment of the hose connector 148 includes a swivel portion 152, nut portion 154 and collar 156 for providing a swivel connection to the hose 150. Such a combination permits easy replacement of parts. A key 158 is carried by the collar 156 to fix the bumper 14 in a forward position.

Various embodiments of the present invention have been herein described in the drawings and specification, by way of example. Although specific terminology was employed, the terms are used in a descriptive sense only and not for purposes of limitation. The invention has been described in detail with specific reference to these illustrated embodiments. However, it will be apparent that various modifications and changes may be made while keeping within the teachings and scope of the invention as described in the foregoing specification and as defined in claims.

What is claimed is:

1. An apparatus for cleaning surfaces submerged in a fluid, the apparatus comprising:

a housing having a single flow passage extending from an inlet to an outlet for a flow of fluid and debris therethrough, wherein a partition wall extends into the single flow passage such that the flow of fluid and debris are constrained to pass through an opening formed thereby and pass to the outlet, which outlet is adapted for connection to a suction source;

a flexible plate carried proximate the inlet for engaging a submerged surface to be cleaned;

a valve pivotally carried within the flow passage for interrupting fluid flow therethrough during an oscillation thereof between a seated position for interrupting the flow therethrough to an unseated position permitting the flow therethrough, wherein a suction of the fluid through the single passage causes an oscillating of the valve between the seated and the unseated positions and a movement of the housing across the submerged surface to be cleaned; and a retractable element moveable between a valve distal end and the partition wall for reducing a gap formed therebetween, thus substantially limiting the flow of the fluid and debris to only one side of the valve.

2. An apparatus according to claim 1, further comprising the retractable element dimensioned wherein the fluid flow through the single passage causes the retractable element to have slidable engagement between the valve distal end and the partition wall during the oscillation of the valve.

3. An apparatus according to claim 1, wherein the single flow passage is defined by opposing top and bottom walls in combination with opposing sidewalls, and wherein the valve contacts the bottom wall in the seated position and oscillates between the seated position and a stop at the top wall.

4. An apparatus according to claim 3, wherein the top wall comprises an access opening enclosed by a detachable cover, the access opening providing access to the valve.

5. An apparatus according to claim 4, wherein the partition wall is integrally formed with the cover.

6. An apparatus according to claim 1, further comprising a pivot pin carried by the housing, wherein a proximal end of the valve is pivotally connected to the pivot pin for rotation thereabout.

7. An apparatus according to claim 1, wherein the valve comprises:

an elongate arm having a proximal end for pivoting the valve thereabout; and a head portion at a distal end of the elongate arm, the distal end operable upstream the proximal end.

8. An apparatus according to claim 7, wherein the head portion includes a slot extending therethrough for slidably receiving the retractable element therein.

9. An apparatus according to claim 8, wherein the head portion includes a protrusion extending outward therefrom for slidably receiving the retractable element thereon.

10. An apparatus according to claim 1, wherein the partition wall includes a slot extending therethrough for slidably receiving the retractable element therein.

11. An apparatus according to claim 1, wherein the partition wall includes a protrusion extending outward therefrom for slidably receiving the retractable element thereon.

12. An apparatus according to claim 1, wherein the retractable element is operably attached to one of the valve and the partition wall for the slidable engagement therebetween.

13. An apparatus according to claim 1, wherein the flexible plate comprises:

an upper surface;

a lower surface for contacting the surface to be cleaned;

a peripheral portion including a plurality of tongues outwardly extending thereabout, wherein each of the plurality of tongues includes a lower surface portion for contacting the surface to be cleaned and a portion in a spaced relation with the surface to be cleaned during operation of the apparatus, thus upwardly lifting an outer most periphery of the plate from the surface to be cleaned.

14. An apparatus according to claim 13, further comprising at least one rib integrally formed with the upper surface of the flexible plate, wherein at least one of the plurality of tongues includes the at least one rib for reinforcing the portion in a spaced relation with the surface to be cleaned.

15. An apparatus according to claim 13, further comprising a plurality of reinforcing elements integrally formed with the flexible plate for upwardly contouring the periphery thereof from the surface to be cleaned.

16. An apparatus according to claim 15, wherein the reinforcing element comprises a rib integrally formed with the upper surface of the flexible plate, the rib extending outwardly while confined within the peripheral portion of the flexible plate.

17. An apparatus according to claim 15, wherein the reinforcing element comprises a flange extending along a peripheral edge of the tongue.

18. An apparatus according to claim 13, wherein the plate further comprises a plurality of slots extending outwardly from a center thereof.

19. An apparatus according to claim 18, wherein the plate further comprises a plurality of slits with each one of the plurality of slits extending from each one of the plurality of slots outwardly to the peripheral portion.

20. An apparatus according to claim 18, wherein each of the plurality of slots extends through the peripheral portion.

21. An apparatus according to claim 18, wherein each of the plurality of slots is tapered.

22. An apparatus according to claim 18, wherein each of the plurality of slots is tapered for providing a smaller gap between walls of the slot as the gap approaches the peripheral portion.

23. An apparatus according to claim 18, wherein each of the plurality of slots extends along a first imaginary line centrally position between a second imaginary line passing centrally through each of the plurality of tongues.

24. An apparatus according to claim 13, wherein the lower surface comprises a plurality of grooves therein extending outwardly from a center thereof.

25. An apparatus according to claim 24, wherein at least a portion of the plurality of grooves extends only partially between the center and peripheral portion of the plate.

26. An apparatus according to claim 13, wherein the plate comprises a plurality of pleats extending outward from a center thereof, each pleat forming a groove within the lower surface and a protrusion within the upper surface.

27. An apparatus according to claim 13, wherein the plate comprises a plurality of holes extending from the upper surface to the lower surface thereof for modifying a suction provided by the flexible plate during operation of the apparatus with a suction source.

28. An apparatus for cleaning surfaces submerged in a fluid, the apparatus comprising:

a housing having a flow passage extending longitudinally from an inlet to an outlet for a flow of fluid and debris therethrough, wherein a partition wall extends into the flow passage such that the flow of fluid and debris are constrained to pass through an opening formed thereby;

a valve operable within the flow passage for interrupting fluid flow therethrough during an oscillation thereof; and a retractable element moveable generally longitudinally between the valve and the partition wall for reducing a gap formed therebetween.

29. An apparatus according to claim 28, further comprising the retractable element dimensioned wherein the fluid flow through the passage causes the retractable element to have slidable engagement between the valve distal end and the partition wall during the oscillation of the valve.

30. An apparatus according to claim 28, wherein the housing comprises an access opening enclosed by a detachable cover, the access opening providing access to the valve.

31. An apparatus according to claim 30, wherein the wall is integrally formed with the cover.

32. An apparatus according to claim 28, further comprising a pivot pin carried by the housing, wherein the valve is pivotally connected to the pivot pin for rotation thereabout.

33. An apparatus according to claim 28, wherein a distal end of the valve includes a slot extending therethrough for slidably receiving the retractable element therein.

34. An apparatus according to claim 28, wherein a distal end of the valve includes a protrusion extending outward therefrom for slidably receiving the retractable element thereon.

35. An apparatus according to claim 28, wherein the partition wall includes a slot extending therethrough for slidably receiving the retractable element therein.

36. An apparatus according to claim 28, wherein the partition wall includes a protrusion extending outwardly therefrom for slidably receiving the retractable element thereon.

37. An apparatus according to claim 28, wherein the retractable element is operably attached to one of the valve and the partition wall for the slidable engagement therebetween.

38. An apparatus for cleaning surfaces submerged in a fluid, the apparatus comprising:

a housing having a flow passage extending longitudinally from an inlet to an outlet for a flow of fluid and debris therethrough;

a valve operable within the flow passage for interrupting fluid flow therethrough during an oscillation thereof;

a flexible plate carried proximate the inlet for engaging the surface to be cleaned, the flexible plate having an upper surfaces, a lower surface for contacting the surface to be cleaned, and a peripheral portion including a plurality of tongues extending outwardly thereabout, wherein a lower surface portion of the tongues curves upwardly; and a reinforcing element formed with each of the plurality of tongues for upwardly lifting the lower surface portion of the tongues from the surface to be cleaned, wherein the reinforcing element is confined within the peripheral portion of the flexible plate so as not to extend outwardly therebeyond.

39. An apparatus according to claim 38, wherein the reinforcing element comprises a rib integrally formed with the upper surface of the flexible plate.

40. An apparatus according to claim 38, wherein the reinforcing element comprises a flange extending along a peripheral edge of the tongue.

41. An apparatus according to claim 38, wherein the plate further comprises a plurality of slots outwardly extending from a center thereof.

42. An apparatus according to claim 41, wherein the plate further comprises a plurality of slits and wherein each one of the plurality of slits extends from each one of the plurality of slots outwardly through the peripheral portion.

43. An apparatus according to claim 41, wherein each of the plurality of slots extends through the peripheral portion.

44. An apparatus according to claim 41, wherein each of the plurality of slots is tapered.

45. An apparatus according to claim 41, wherein each of the plurality of slots is tapered for providing a smaller gap between walls of the slot as the gap approached the peripheral portion.

46. An apparatus according to claim 41, wherein each of the plurality of slots extends along a first imaginary line centrally positioned between a second imaginary line passing centrally through each of the plurality of tongues.

47. An apparatus according to claim 38, wherein the lower surface comprises a plurality of grooves therein extending outwardly from a center thereof.

48. An apparatus according to claim 47, at least a portion of the plurality of grooves extends only partially between the center and the peripheral portion of the plate.

49. An apparatus according to claim 38, wherein the plate comprises a plurality of pleats extending from a center thereof, each pleat forming a groove within the lower surface and a protrusion within the upper surface.

50. An apparatus according to claim 38, wherein the plate comprises a plurality of holes extending from the upper surface to the lower surface for modifying a suction provided by the flexible plate during operation of the apparatus with a suction source.

51. An apparatus according to claim 38, wherein the plurality of tongues extend radially outward from a center of the flexible plate.

52. An apparatus according to claim 38, wherein the lower surface portion of the tongues comprises a first portion contacting the surface to be cleaned and a second outermost portion curved upwardly.

* * * * *